United States Patent [19]

Wiese et al.

[11] 4,033,228

[45] July 5, 1977

[54] ZONE SETTING ASSEMBLY WITH TEMPERATURE COMPENSATOR FOR WEAPON SYSTEMS OF THE "SOFT RECOIL" TYPE

[75] Inventors: Harold Herman Wiese, Davenport, Iowa; Steven Ray Schade, Rock Island, Ill.

[73] Assignee: The United States of America as represented by the Secretary of the Army, Washington, D.C.

[22] Filed: June 28, 1976

[21] Appl. No.: 700,641

[52] U.S. Cl. ..... 89/42 B

[51] Int. Cl.[2] ..... F41F 19/10

[58] Field of Search ..... 89/42 B

[56] References Cited

UNITED STATES PATENTS

| | | | |
|---|---|---|---|
| 3,566,740 | 3/1971 | Williams et al. | 89/42 B |
| 3,919,918 | 11/1975 | Rudman | 89/42 B |

OTHER PUBLICATIONS

Gilbert J. Melow, Jr., "Soft Recoil, Hard Punch," Army, Feb. 1970, pp. 52–54.

*Primary Examiner*—Stephen C. Bentley

*Attorney, Agent, or Firm*—Nathan Edelberg; Harold H. Card, Jr.; Robert O. Richardson

[57] ABSTRACT

"Soft Recoil" type weapon systems automatically fire from out of battery positions, i.e., while moving in the counterrecoil direction of conventional recoil weapon systems, in response to the zone setting of a velocity sensor firing pin actuator.

The present invention comprises a zone setting assembly with a temperature compensator which has a manually actuable control handle carrying an indexing means, such as pins, and a pointer or indicator. The handle is indirectly connected to the actuator shaft of the velocity sensor valving system so that pivoting movement of the handle rotates the sensor shaft to set the sensor valving, whereby the firing pin is actuated to initiate firing in response to the zone setting of the handle visually indicated by the pointer on a fixed dial plate carrying zone indicia. The pins are utilized to latch the handle prior to firing when the pointer is in position indicating the appropriate zone on the dial face. The temperature compensator assembly includes a means directly connected to the sensor shaft for fine adjustable movement of the control handle to compensate for variations in ambient temperature.

4 Claims, 4 Drawing Figures

ZONE SETTING ASSEMBLY WITH TEMPERATURE COMPENSATOR FOR WEAPON SYSTEMS OF THE "SOFT RECOIL" TYPE

GOVERNMENT RIGHTS

The invention described herein may be manufactured and/or used by or for the Government for governmental purposes without the payment of any royalty thereon.

BACKGROUND OF THE INVENTION

In weapon systems of the soft recoil type wherein triggering of the firing mechanism is initiated while the gun tube is in an "out-of-battery" position, firing actuator devices have been employed which actuate the firing pin in response to sensing of the velocity of the gun tube moving into a pre-selected out-of-battery firing position.

The out-of-battery firing position of the gun tube is variable and is dependent upon the target zone requirement of a particular firing exercise.

Differences in zone firing requirement, i.e., firing to different zones, require propellant charges of different weights, e.g., range distances require different charges of different weights as do different trajectory apogees within the same range. Thus for long ranges and high trajectories within short ranges, the distance of movement of the gun tube to the firing position is longer than the distance of movement of the gun tube to the firing position where the ranges are shorter and the trajectories are shorter.

To vary the distance of movement of the gun tube to different firing positions and, thus, the zone settings of the system, a velocity sensing device is employed by which triggering of the firing pin is initiated by the sensing device in response to a pre-selected velocity of the gun tube having been reached in traveling to its out-of-battery firing position.

SUMMARY OF THE INVENTION

To vary the zone setting of the system, it was found that the sensor device could be activated with a simple activator assembly to adjust the zone setting of the system. The actuator assembly was also designed to minimize the number of parts required, provide manual setting and variation of the setting of the sensor device and, hence, the zone setting of the system and to provide an assembly which would usually indicate simply to the firing crew whether the proper zone setting was achieved.

These objects, features and advantages of the present invention are achieved by the utilization of a zone setting assembly including a plurality of indicia markings, each selectively calibrated to correspond to and indicate different zone settings of the sensor device and fixedly carried by the weapon system; a manually actuatable means movably carried by the system and calibrated to actuate predetermined variations in the firing velocity settings of the sensor device relative to the position of said movable means and said indicia means thereby to vary correspondingly and selectively the zone settings responses of the system, and means fixedly carried by said movable means to indicate visually selected displacement correlations of the position of the manually actuatable means relative to the calibrated position of a selected indicia marking.

DESCRIPTION OF A PREFERRED EMBODIMENT

Figure 1:
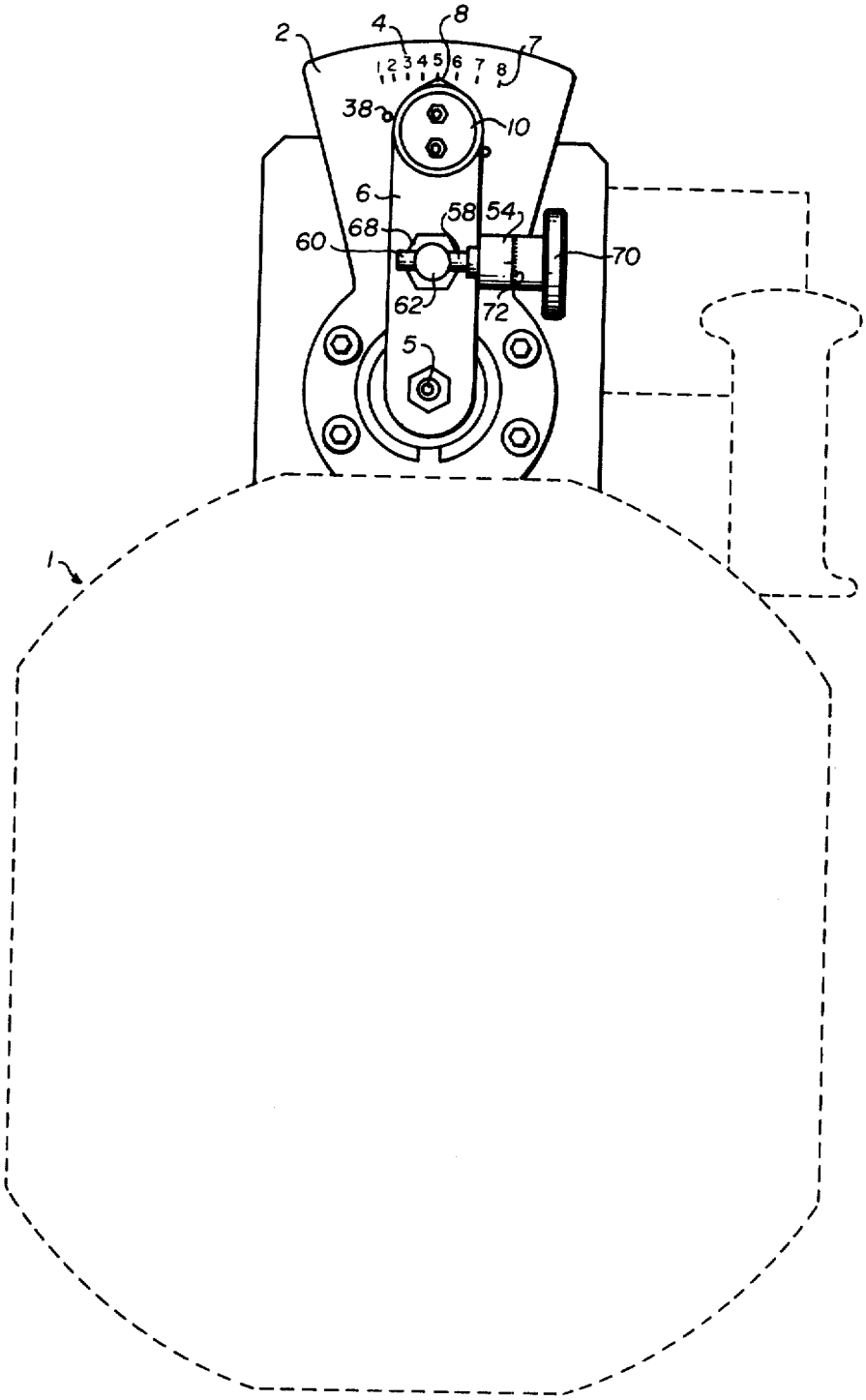
FIG. 1 is a front view in elevation of a preferred embodiment of the present invention mounted on the breech shown in dotted lines of a soft recoil weapon system (not shown).

Referring to FIG. 1, there is illustrated in dotted lines the breech end 1 of a soft recoil type weapon system. Mounted above the breech block 1 is a dial face plate 2 having spaced numerical indicia thereon (sequentially numbered 1 to 8) defining an arc. These numerals correspond to different zone settings of a sensor device (not shown) which through valving (not shown) is capable of adjusting the setting of the firing sequence of the weapon system through eight pre-selected firing zones.

An elongated control lever 6 is vertically disposed for pivoting an actuating shaft 5 (FIG. 2) of the sensor device. Adjacent its opposite end the control lever 6 is shaped to define an indicator pointer 8 for alignment with indexing markings 7 to correlate the pointer tip with the numerical indicia 4 on the dial face plate 2.

Figure 2:
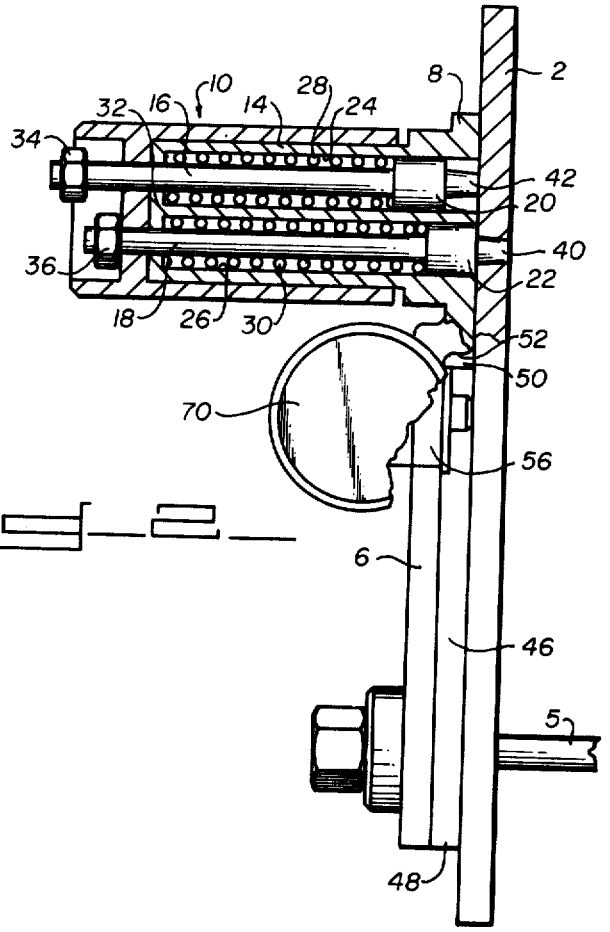
FIG. 2 is a side view in partial section of the pivotable indexing assembly shown connected to the shaft of a velocity sensor device used to trigger firing of the weapon system.

Referring to FIG. 2, an indexing actuator handle assembly 10 is shown which includes a movable housing 12 circumscribing a radial extension 14 formed integral with the lever 6. Extending through the housing 10 and extension 14 are a pair of spaced indexing pins 16 and 18. The pins 16 and 18 have enlarged guide heads 20 and 22 respectively seated for movement in recesses 24 and 26 formed in the extension 14. A plurality of spring means 28 and 30 each bottomed at one end against the guide heads 20 and 22 and each bottomed at their other ends against the end walls 32 of the corresponding extension 14 to urge the pins 20 and 22 towards the dial plate 2. Nuts 34 and 36 may be utilized to complete the assembly 10.

The dial face plate (FIG. 1) has a plurality of spaced apertures 38, eight in number in this embodiment, to correspond to the eight zone settings pre-selected for the weapon system. Because the zone settings indicia between 1 and 5 are spaced close together, as dictated by the fact that closer zone settings of the sensor are rather close together, the indexing apertures have been staggered so that the apertures do not overlap each other, as clearly appears from FIG. 1. Consequently, each of the pair of spacial indexing pin heads 40 and 42 are aligned for selective automatic seating only in four of the eight apertures 38 and then only one pin head (pin 42 in FIG. 2) is seatable in the selective zone setting aperture 38 while the other pin head 40 is unseatedly biased outwardly by the dial plate against the force of spring 30.

In the embodiment illustrated in the drawings, the control lever 6 is not directly keyed to the sensor control shaft 5 although its pivotry movement actuates zone resetting of the sensor shaft 5.

Control lever 6 is in engagement with a second fine adjustment lever 46 which is mounted for pivotable movement with the control lever 6, at one end 48. The other end 50 of the lever 46 is nested in an offset portion 52 of the lever 6.

Lever 46 is provided for fine adjustment of the sensor shaft 5, once the shaft 5 has been set in a desired zone position.

Figure 3:
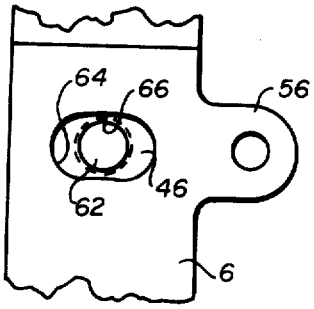
FIG. 3 is a fragmentary view in elevation illustrating the mounting and slot arrangement of the control handle and temperature compensator assembly.
Figure 4:
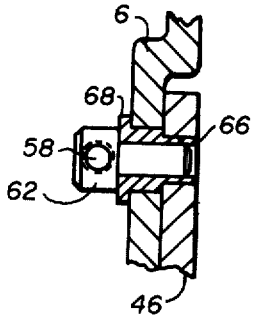
FIG. 4 is a fragmentary view in cross section showing the connection between the temperature compensator assembly and control handle.

To actuate movement of the lever 46 a fine adjustment assembly is provided which comprises a housing 54 fixedly mounted (FIG. 1) on a tab 56 of lever 6 (FIG. 3). A rotatable shaft 58 extends through the housing 54. The end 60 of the shaft 58 is in movably threaded engagement with the correspondingly threaded base of a shaft member 62 (FIG. 4) which extends perpendicularly to the dial plate 2. The shaft 62 extends through a slot 64 (FIG. 3) formed in the control lever 6 and into an aperture 66 of the lever 46 (FIG. 4) A stepped bushing 68 is provided for the shaft 62 to assure a snug fit of the shaft 62 in the aperture 66.

At its outer level shaft 58 carries a vernier adjusting screw 70 having indicia 72 thereon keyed to a predetermined temperature adjustment table (not shown).

Threading of the shaft 58 causes pivotry of the lever 46 which, in turn, applies a turning force dictated by the setting of the vernier head 70 to the sensor shaft 5, thereby providing a means for fine adjustment or displacement of the shaft 5 in pre-calibrated amounts sufficient to compensate for ambient temperature variations in the physical characteristics of the weapon system firing mechanism.

In operation, a firing exercise is commanded indicating a particular firing zone. A crew member, in response to the command, pulls the handle housing 10 (FIG. 2) outwardly which, in turn, disengages one or the other of the pins 20 and 22 to unseat such pin from a zone aperture 38 to permit pivotry movement of the lever 6 which carries with it lever 46. Pivotry movement of lever 6 rotates the shaft 5 of the sensor device (not shown). When the pointer 8 of the lever 6 corresponds to the desired zone setting, the crewman releases the handle 10, the springs 28 and 30 bias the indexing pins 16 and 18 toward the dial plate 2 and, depending on the zone setting desired, one or the other of the pin heads 40 and 42 seats in the corresponding aperture 38 corresponding to the numerical zone indicating indicia 4 to latch the control lever 6 in position. The lever 6 is mounted to the sensor shaft 5 so that the incremental zone setting displacements of the sensor shaft 5 correspond to the zone setting indicia 4. Thus, a number "5" setting of the lever 6 will result in a displacement of the sensor shaft 5 to a position where the sensor device will not trigger the firing mechanism of the weapon system until the velocity of the traveling gun tube reaches a value which will result in a projected projectile trajectory to target zone 5.

The responsible crewman also checks a table indicating the temperature adjustment, if any, required for the particular zone setting under the ambient weather conditions. If an additional adjustment of the sensor shaft 5 is required, the crewman reads the vernier setting on the table corresponding to the temperature indicated and then correspondingly adjusts the vernier setting on the fine adjustment assembly by turning the knob 70. Rotation of knob 70 causes rotation of shaft 58 which in turn causes movement of the lever 46 in offset relation to latched lever 6. Movement of lever 46 rotates the sensor shaft 5 a predetermined distance precalibrated to compensate for temperature variations in the zone setting of the sensor device. The weapon system is now ready for firing to the selected number 5 target zone.

It will be appreciated that by employment of the present invention new and improved means are provided for effectively and positively varying the zone settings of the sensor device of a soft recoil type weapon system and which permits simplified manual setting of the zone indicator which is visually inspectable by the crewmen.

It is desired that the concepts of the present invention not be limited to the exact details of construction shown and described, for structural modifications will occur to a person skilled in the art, and it is to be understood that these modifications are part of the invention as claimed.

What is claimed is:

1. In a soft recoil weapons system having a breech end and an adjustable velocity sensing device including a shaft for actuating automatic firing of the system when the gun tube velocity during travel toward the muzzle end has reached a predetermined value so that different zones may be targeted, the improvement comprising:

means for varying the velocity response of said sensing device including a dial face member with spaced calibrated zone setting indicia fixedly mounted on said breech end;

a plurality of spaced pin receiving apertures arranged in said dial face member calibrated to correspond to individual zone setting indicia;

a control member pivotably connected at one end to rotate said sensing device shaft;

a manually actuatable indexing pin handle movably carried at the other end of said control member adjacent the apertures in the dial face member;

a plurality of indexing pins carried for reciprocable movement by the handle, with each pin positioned to engage preselected ones of said apertures depending upon the position of said control handle; and means biasing said pins toward said apertures, whereby, at preselected locations, one or the other of said pins seats in a preselected aperture corresponding to a desired zone setting indicia to latch said control handle in said zone setting position so that said sensor shaft is locked in the desired zone setting position, said pin indexing handle being movable relative to said control handle member to unseat said pins and permit free pivoting movement of said control member for resetting of the zone.

2. The improvement of claim 1 including a fine adjustment calibrated assembly for providing additional minute displacement of the sensor shaft, said assembly being precalibrated to compensate for the effects of variations in temperature on the physical characteristics of the sensor shaft.

3. The improvement of claim 2 wherein said fine adjustment assembly includes a lever member fixedly carried at one end for moving said sensor shaft;

a movable shaft receiving member extending through and rideable in a slot in said control handle and in engagement with said lever member for movement thereof;

and an adjustment shaft movably carried by said control handle for engagement with said shaft receiving member to move said shaft lever member whereby said lever member and sensor shaft are movable in response to the movement of the shaft receiving member.

4. The improvement of claim 3 wherein said adjustment shaft fixedly carries a head with calibration indicia thereon and movably extends through a housing fixed to the control handle with an indexing marking thereon.

* * * * *